US006854616B2

(12) United States Patent
Steffan

(10) Patent No.: US 6,854,616 B2
(45) Date of Patent: Feb. 15, 2005

(54) PROTECTIVE VALVE CAP

(75) Inventor: Daniel J. Steffan, Erie, PA (US)

(73) Assignee: Alliance Plastics, Erie, PA (US)

( * ) Notice: Subject to any disclaimer, the term of this patent is extended or adjusted under 35 U.S.C. 154(b) by 52 days.

(21) Appl. No.: 10/134,537

(22) Filed: Apr. 30, 2002

(65) Prior Publication Data

US 2003/0201266 A1 Oct. 30, 2003

(51) Int. Cl.[7] ..... B65D 17/34

(52) U.S. Cl. ..... 220/270; 220/323; 220/805; 220/287; 220/793; 220/724; 220/799; 215/254; 215/319; 222/182

(58) Field of Search ..... 220/784, 799, 220/293, 345.2, 725, 258.2, 270, 287, 794, 323, 805, 724, 915, 793, 266, 791; 222/182, 541.6, 541.9, 153.06, 153.07, 153.1; 215/255, DIG. 1, 254, 224, 220, 305, 319, 252, DIG. 4, 253; 138/96 R, 88.1, 89.3, 89.4; D9/438, 445

(56) References Cited

U.S. PATENT DOCUMENTS

| | | | | | |
|---|---|---|---|---|---|
| 3,102,658 | A | * | 9/1963 | Rosen | 220/270 |
| 3,684,124 | A | * | 8/1972 | Song | 220/270 |
| 4,276,988 | A | * | 7/1981 | Kimm et al. | 215/254 |
| 4,550,844 | A | * | 11/1985 | Lininger | 215/252 |
| 4,595,110 | A | * | 6/1986 | Herr | 215/252 |
| 4,616,763 | A | * | 10/1986 | Ruhl | 220/270 |
| 4,645,087 | A | | 2/1987 | Kusz | |
| 4,664,288 | A | * | 5/1987 | Pereira et al. | 220/203.09 |
| 4,712,705 | A | | 12/1987 | Fuehrer | |
| 4,729,488 | A | | 3/1988 | Bullock, III | |
| 4,779,750 | A | | 10/1988 | Armstrong | |
| 4,784,296 | A | | 11/1988 | Bullock | |
| 5,065,883 | A | * | 11/1991 | Udell | 220/276 |
| 5,195,561 | A | * | 3/1993 | Wilson | 138/89.2 |
| 5,249,704 | A | * | 10/1993 | Boetzkes | 220/724 |
| 5,875,908 | A | * | 3/1999 | Witt et al. | 215/256 |
| 5,996,833 | A | | 12/1999 | Lencioni et al. | 220/257 |
| 6,260,721 | B1 | * | 7/2001 | Ohmi et al. | 215/256 |
| 6,286,702 | B1 | * | 9/2001 | Buermann | 220/229 |

FOREIGN PATENT DOCUMENTS

| | | | | | |
|---|---|---|---|---|---|
| EP | 761556 | A1 | * | 3/1997 | B65D/41/48 |
| GB | 2182915 | A | * | 5/1987 | B65D/41/52 |
| GB | 2301348 | A | * | 12/1996 | B65D/41/48 |
| JP | 11292113 | A | * | 10/1999 | B65D/41/32 |

* cited by examiner

*Primary Examiner*—Lee Young
*Assistant Examiner*—James Smalley
(74) *Attorney, Agent, or Firm*—Oliff & Berridge, PLC

(57) ABSTRACT

A protective cap for a threaded valve stem includes a generally cylindrical portion including a closed end, an open end and a cylindrical wall portion therebetween. A plurality of locating ribs are located on an internal surface of the cylindrical wall portion. A plurality of fingers project radially inward from the internal surface between the locating ribs. A tear strip formed by two frangible members, and a pull tab are formed on an external surface of the cylindrical wall portion. Each finger is located between a pair of the locating ribs and has a flexible portion adjacent the internal surface for locating the fingers in unlocked state and a locked state. The fingers in the unlocked state are inclined toward the open end, and the fingers in the locked state curl toward the closed end.

10 Claims, 9 Drawing Sheets

PROTECTIVE VALVE CAP

BACKGROUND OF THE INVENTION

1. Field of Invention

This invention relates to a protective cap for a threaded valve stem. In particular, the application relates to a tamper resistant, easily removable, protective cap for a propane gas tank valve stem, that provides the purchaser with a convenient visual identification that the tank is full.

2. Description of Related Art

Conventionally, for propane valves, for example, new QCC propane valves, labels are used to indicate when a propane tank has not been used or has been filled with propane. With the tanks stored outside, for example, the labels are exposed to rain, snow, wind and the like, which may cause the labels to eventually degrade or fall off. In addition, the labels can be easily manually removed from the valve. Therefore, it is difficult to make sure that the propane in the tank has not been used. Furthermore, with such labels, if the tanks are stored outside, dust and/or dirt may build up on the valve. As such, more protection is needed for the propane valves for security and contamination purposes.

U.S. Pat. No. 4,712,705 to Fuehrer discloses a tamper indicating cap seal for container valves. The cap includes an upper body portion which is securely engagable over a valve and completely covers a plug of the valve, a lower skirt portion attached to the upper body that covers lower part of the valve, and a plurality of teeth that are formed inside the upper body to fit in inclined surfaces of the valve to provide locking of the cap onto the valve. The cap also includes a tear strip member constituted by a pair of spaced and parallel weakened grooves formed inside the cap, and a tab attached to the tear strip member, to indicate that the cap has not been removed or tampered and to allow easy removal of the cap from the valve by pulling the tab to break the weakened grooves. The grooves provide vents for escape of air to avoid the trapping of air in the end of the cap when the cap is rapidly pushed into the plug.

However, because the teeth must be made to fit on the inclined surfaces of the valve, the cap must be specifically produced for the valve.

SUMMARY OF THE INVENTION

Accordingly, a cap is desired that can be used on different shapes of valves and that can be tamper-evident and protective. Thus, it is an object of this invention to provide a protective cap for a valve stem that can easily fit on the valve and increase the protection from tampering, while a seal of the cap is easily broken such that the cap can be easily removed from the valve.

A protective cap for a threaded valve stem according to this invention includes a generally cylindrical portion including a closed end, an open end and a cylindrical wall portion therebetween, the cylindrical wall portion having an external surface and an internal surface, a plurality of locating ribs located on the internal surface, and a plurality of fingers projecting radially inward from the internal surface. Each finger is located between a pair of the locating ribs and has a flexible portion that is adjacent the internal surface for locating the fingers in an unlocked state and a locked state. The fingers in the unlocked state are inclined toward the open end, and the fingers in the locked state curl toward the closed end.

The protective cap of this invention may further include a pair of frangible members located on the external surface and extending between the closed end and the open end to define a tear strip, and a pull tab connected to the tear strip at the open end. The pair of frangible members may be located between a pair of corresponding locating ribs.

These and other objects, advantages and salient features of the invention are described in or apparent from the following detailed description of exemplary embodiments.

BRIEF DESCRIPTION OF THE DRAWINGS

Exemplary embodiments of the invention will be described with reference to the following drawings, wherein like numerals represent like parts, and wherein.

DETAILED DESCRIPTION OF PREFERRED EMBODIMENTS

FIGS. 1, 2A, 3 and 4 show an exemplary embodiment of the protective cap according to this invention. FIGS. 2B and 2C show an alternative embodiment for a pull tab and tear strip.

Figure 1:
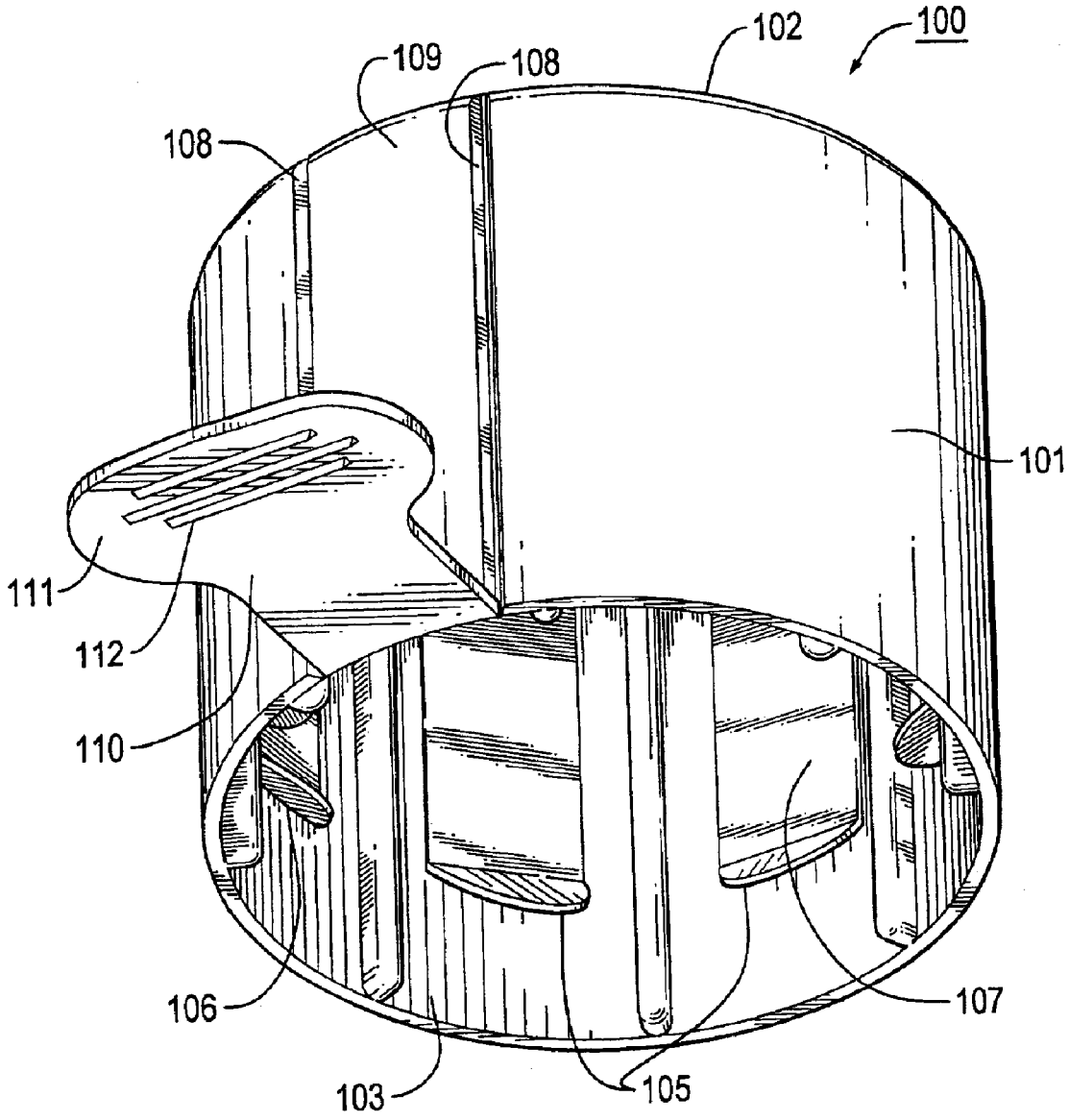
FIG. 1 is a perspective view of a protective cap of this invention.

As shown in FIG. 1, a protective cap 100 may be made of thermoplastic resin that is injection molded. The cap 100 has a generally cylindrical wall portion 101, a closed end 102 and an open end 103. At the closed end 102, the word "Full" or the like may be shown on an external surface to indicate that the propane tank has not been used. Also on the closed end 102, a warning message and/or safety information may be shown. The cylindrical wall portion 101 preferably has a constant diameter but other shapes are possible.

Figure 4:
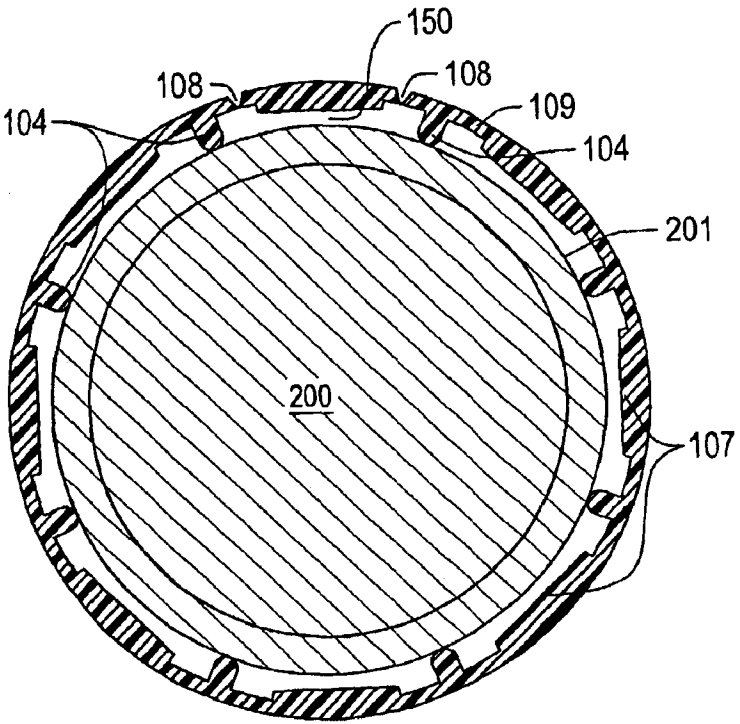
FIG. 4 is a cross-sectional view of the protective cap attached on the valve as viewed along the line A—A shown in FIG. 3.
Figure 3:
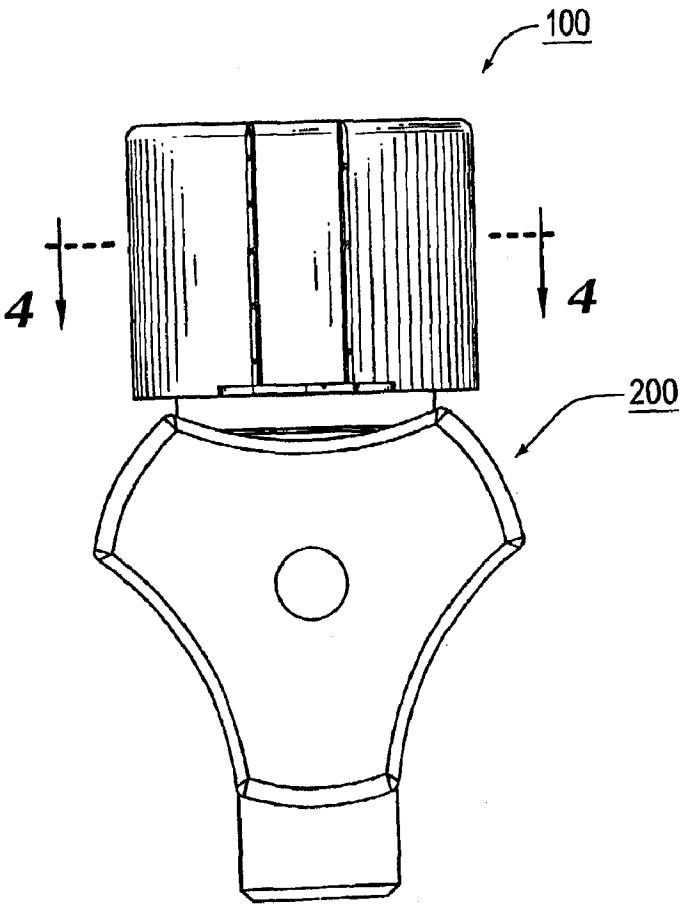
FIG. 3 is a top view of the protective cap attached on a valve.

On an internal surface of the cylindrical wall portion 101, a plurality of locating ribs 104 are formed, which locate a valve 200 (see FIG. 3) to be inserted into the center of the protective cap and to distance the valve 200 from the internal surface of the protective cap as shown in FIG. 4. In the exemplary embodiment, there are eight locating ribs, which are preferably formed symmetrically around the internal diameter of the cap. However, this number is not limited to eight. It may be appreciated by those skilled in the art that any number of the ribs may be possible, and that the ribs may not be formed symmetrically.

The locating ribs 104 extend from the open end 103 to the closed end 102 and provide strength to the protective cap 100 when the valve 100 is inserted into the protective cap 100. The locating ribs 104 have a height (in the radial direction of the cap) that provides sufficient spaces 150 between threads 201 of the valve 200 and later-described platforms 107, as shown in FIG. 4, such that retaining fingers 105 can sufficiently curl when the threads 201 of the valve 200 are inserted within the cap. In addition, the locating ribs may have a round surface and terminate near the open end so that the valve 200 may be inserted easily.

Figure 2A:
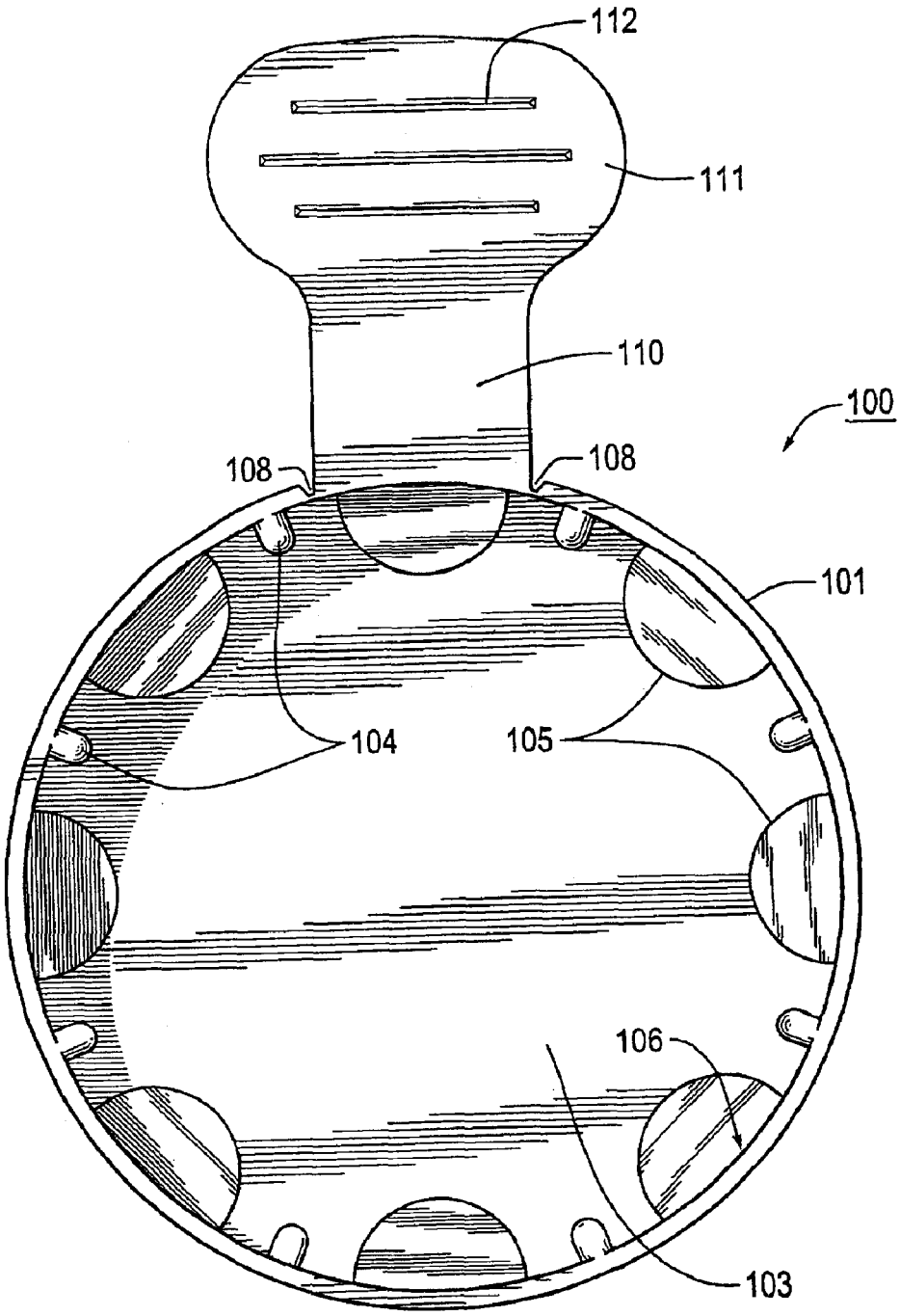
FIG. 2A is a bottom view of the protective cap of FIG. 1, viewed from an open end of the protective cap.
Figure 2B:
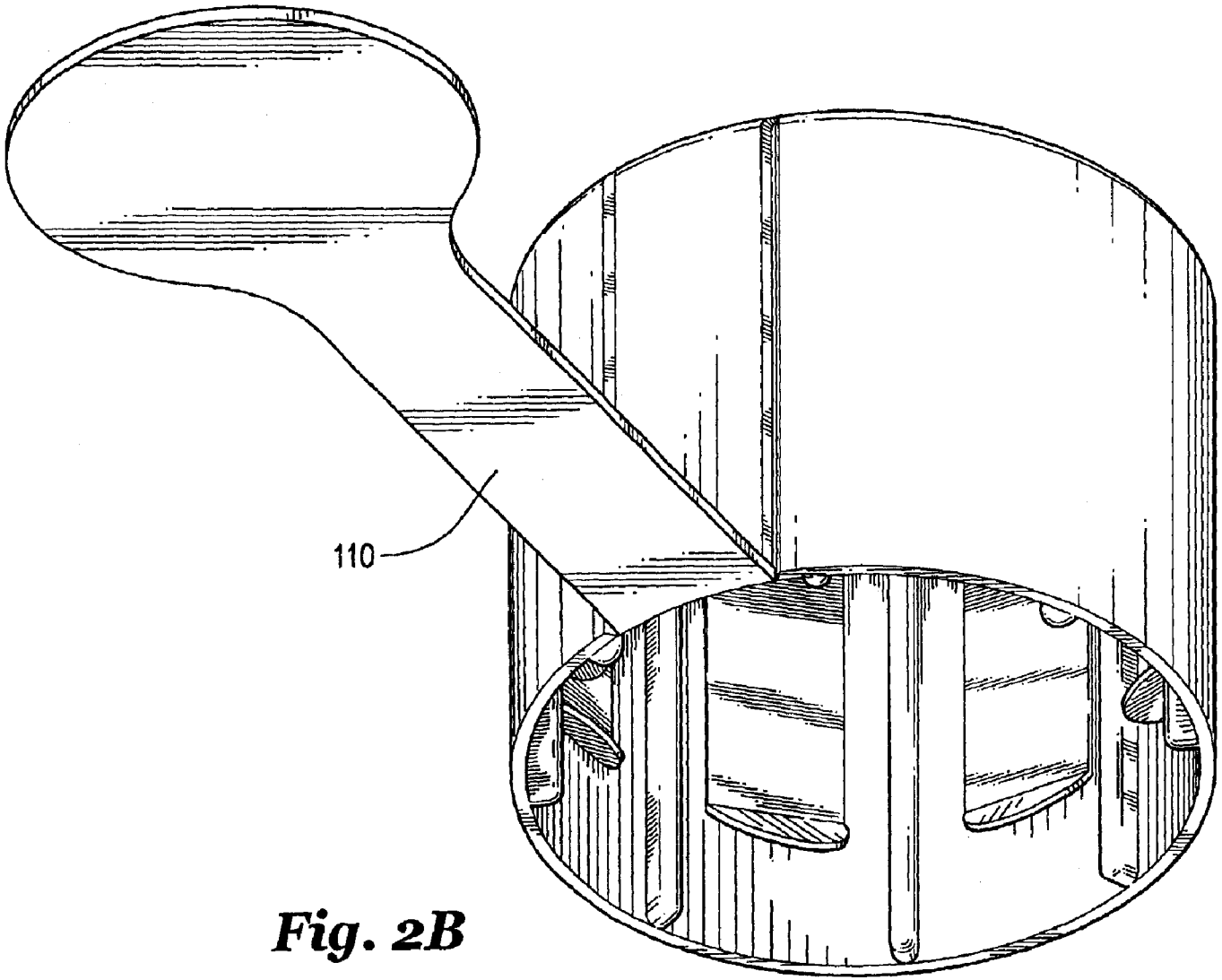
FIGS. 2B and 2C illustrate an alternative embodiment of the protective cap showing a different pull tab arrangement and a different tear strip arrangement.
Figure 2C:
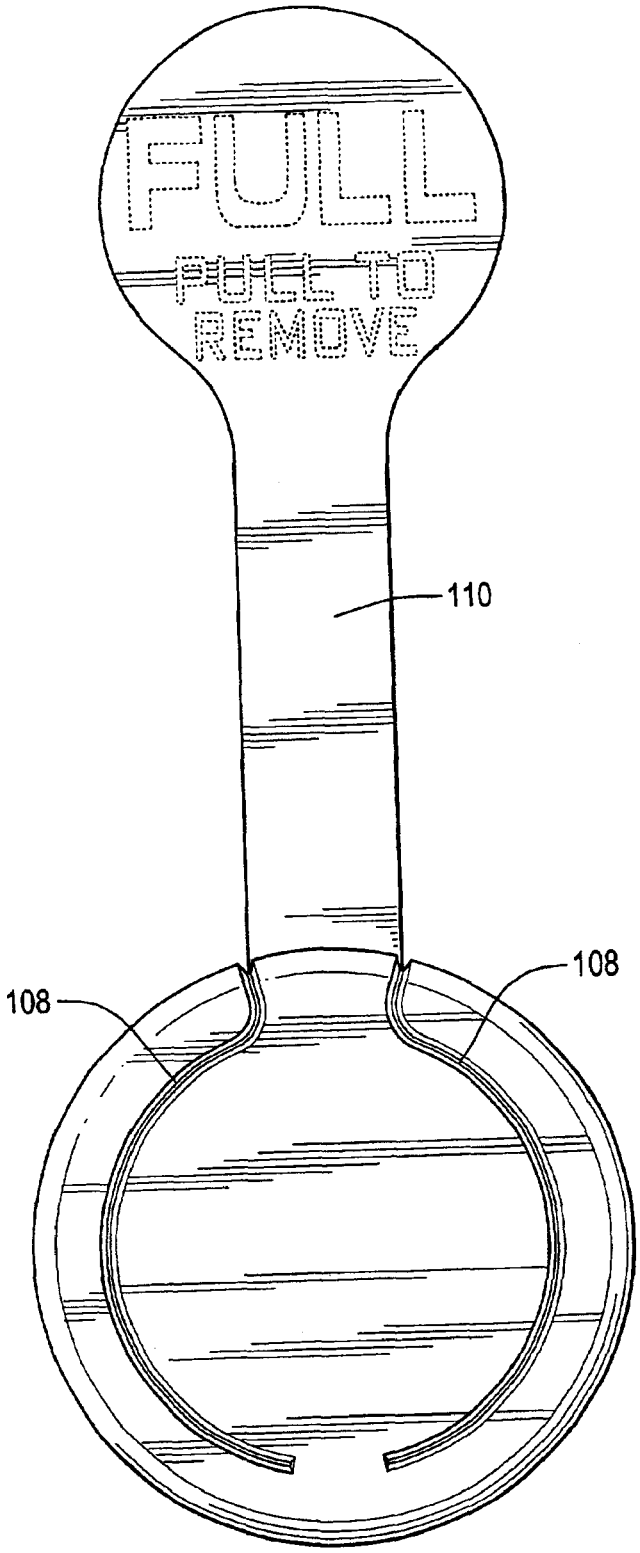

The retaining fingers 105 are formed between the locating ribs 104. The retaining fingers 105 are formed radially inward from the internal surface of the cylindrical wall portion 101 and may be inclined towards the open end when the valve 200 is not inserted (unlocked state) as shown in FIG. 1. As shown in FIG. 2A, each finger 105 may be formed to have a round end and may be made to extend beyond the height (in the radial direction) of the locating ribs 104. Each finger 105 has a flexible portion 106 formed adjacent to the internal surface of the cylindrical wall portion 101. The flexible portion 106 provides flexibility, such that the finger 105 can sufficiently bend and curl when the valve 200 is inserted (locked state) as described later.

Each finger 105 may be formed on a platform 107 (FIG. 1) formed on the internal surface of the cylindrical wall portion 101. Each platform 107 is formed to provide a sufficient clearance for the fingers 105, when molding the protective cap 100. In addition, the platforms 107 extend to the closed end 102 and provide strength to the protective cap 100 and support for forces applied to the fingers 105 when the valve 200 is inserted into the protective cap 100. However, it will be appreciated by those skilled in the art that if desired, the platforms 107 may be omitted.

On the external surface of the cylindrical wall portion 101, a pair of frangible members 108 are formed to extend in the entire length of the cylindrical wall portion 101, i.e., from the closed end 102 to the open end 103, to constitute a tear strip 109. The pair of frangible members are formed between a pair of the locating ribs 104 but outside of the platform 107, as shown in FIG. 2A. In the exemplary embodiment of this invention, the frangible members 108 are formed on the external surface of the cylindrical wall portion 101 and have a V-shape. However, it is apparent for those skilled in the art that the frangible members 108 may be formed on the internal surface of the cylindrical wall portion 101 and may have a U-shape or the like. As illustrated in FIGS. 2B and 2C, the frangible members 108 may extend onto the top of the cap. Any arrangement of the frangible members 108 is possible to define different shapes of the tear strip 109. As described below, breaking of the frangible member 108 splits the cap for removal from the valve stem. Once the frangible members are broken, the cap is destroyed and incapable of re-use.

As shown in FIGS. 1 and 2A, a pull tab 110 is formed on the external surface of the cylindrical wall portion 101 and connected to the tear strip 109. In the exemplary embodiment, the pull tab 110 is formed perpendicular to the cylindrical wall portion 101. However, the pull tab 110 may extend in any direction along the cylindrical wall portion 101. The pull tab 110 may also take different forms and shapes, as illustrated in FIGS. 2B and 2C. Furthermore, in the exemplary embodiment, there may be formed a wide grip portion 111 and/or bumps 112 to enhance gripping by a user. Therefore, by pulling the pull tab 110, the frangible members 108 break, and thus the diameter of the cylindrical wall portion 101 expands. As a result, the fingers 105 are released from the valve threads, allowing the protective cap 100 to be removed from the valve 200.

Next, FIGS. 5–8 show operation of the fingers 105.

Figure 5:
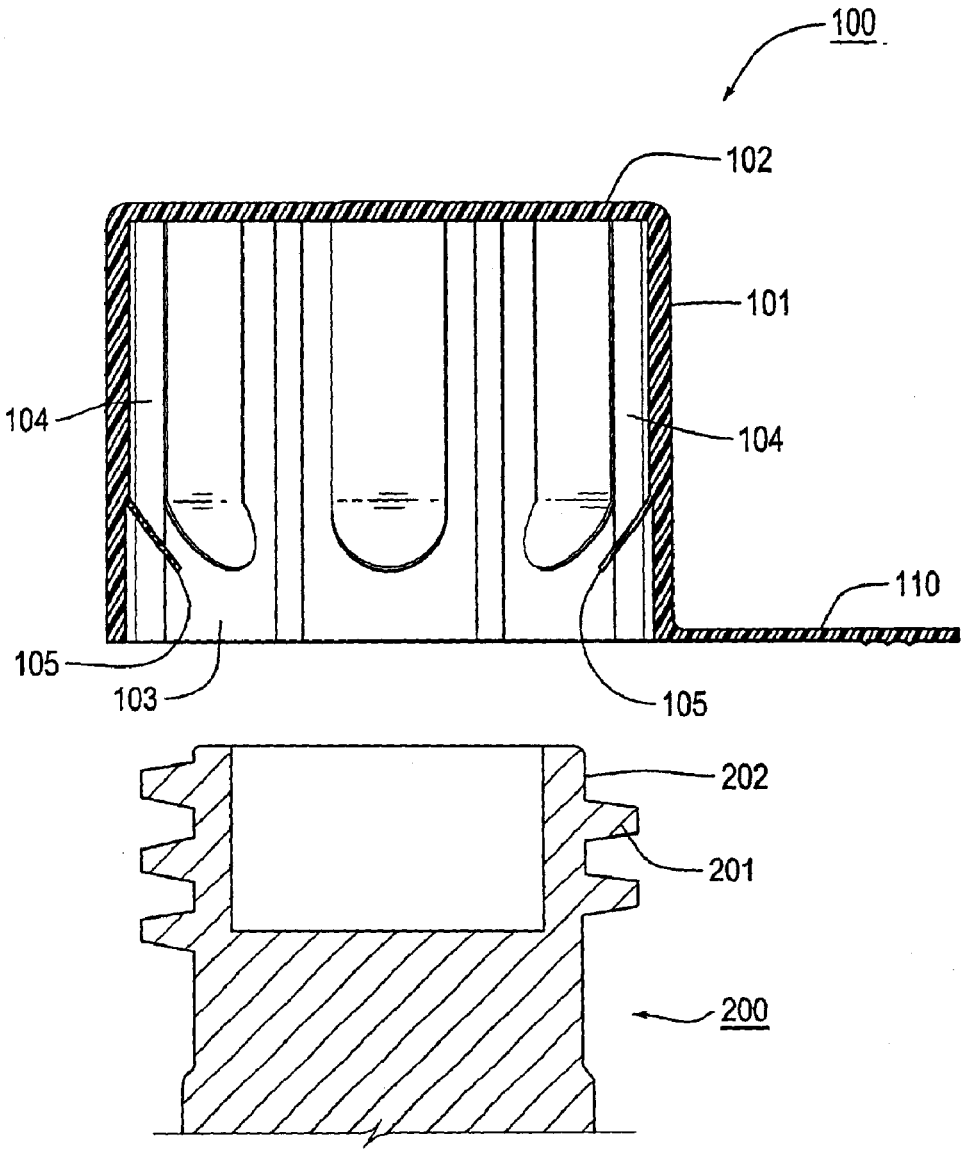
FIG. 5 is a cross-sectional view of the protective cap and the valve in an unlocked state.

FIG. 5 shows an unlocked state in which the valve 200 is not inserted into the protective cap 100. At this time, the fingers 105 project radially inward from the internal surface of the cylindrical wall portion 101 and are inclined towards the open end 103.

Figure 6:
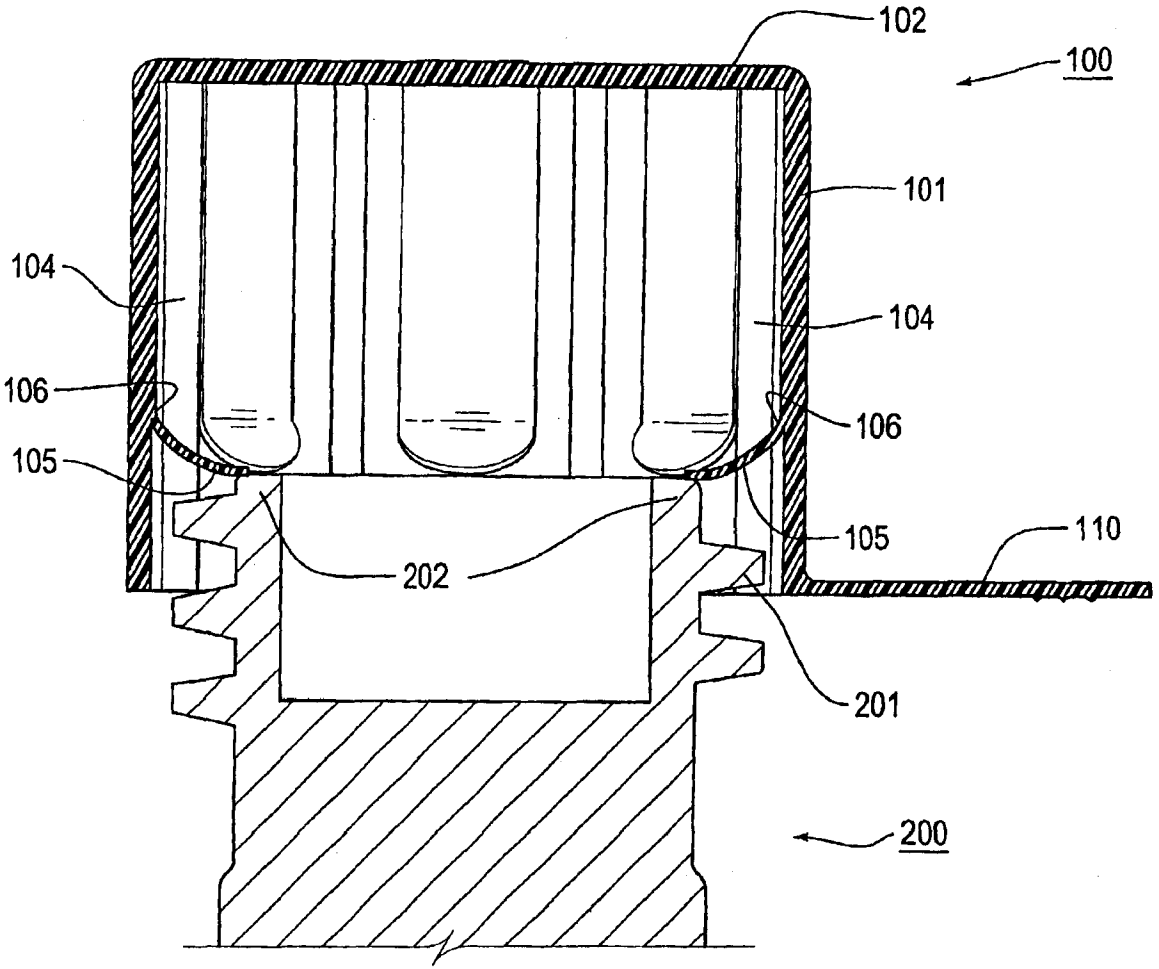
FIG. 6 is a cross-sectional view of the protective cap and the valve engaging with each other.

As shown in FIG. 6, when the valve 200 is inserted into the protective cap 100, the threads 201 of the valve 200 slide on the locating ribs 104 and thus position the valve in the center of the protective cap 100. The front end of the valve port 202 engages with the fingers 105. As the valve 200 is further inserted, the fingers 105 are pushed by the valve port 202 towards the closed end 102, and therefore, the flexible portions 106 of the fingers 105 start to flex to allow the fingers 105 to curl toward the closed end.

Figure 7:
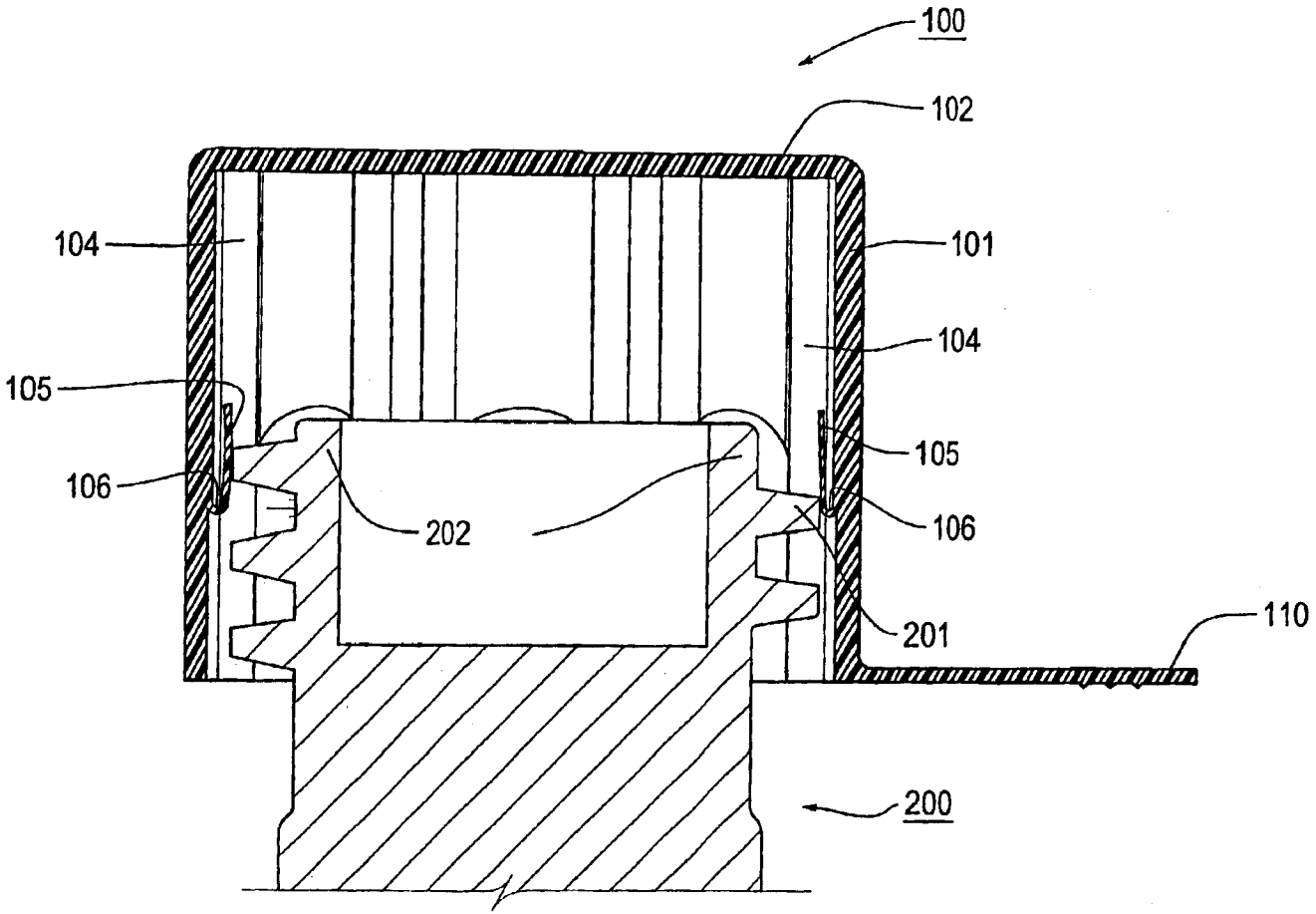
FIG. 7 is a cross-sectional view of the protective cap and the valve when retaining fingers of the protective cap curl under threads of the valve.

As shown in FIG. 7, the fingers 105 are bent flat at the flexible portions 106 when the threads 201 come over the fingers 105. At this time, because of the locating ribs 104, there are spaces 150 between the threads 201 and the platform 107 for the fingers 105 to fall in (see FIG. 3).

Figure 8:
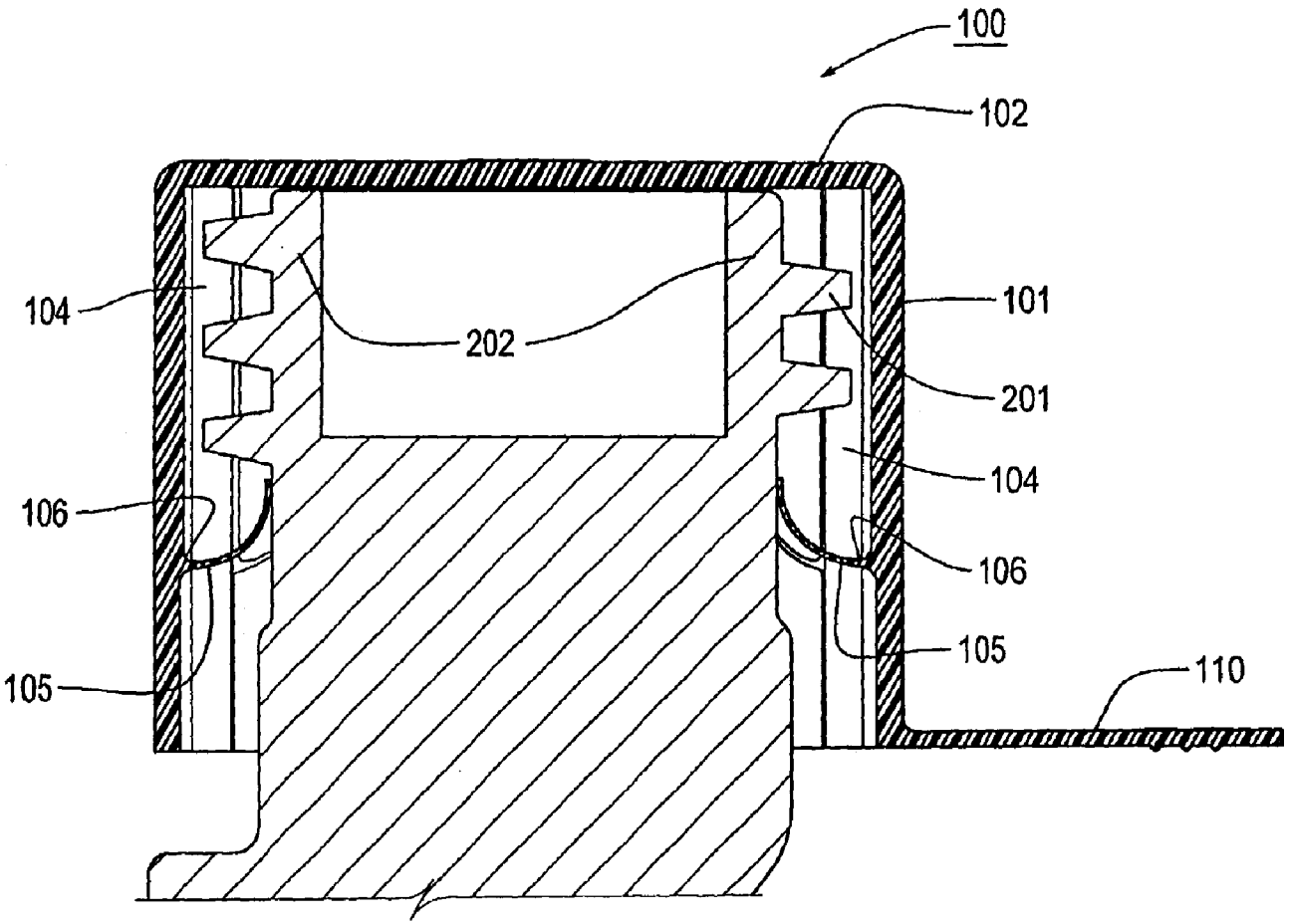
FIG. 8 is a cross section of the protective cap and the valve in a locked state.

FIG. 8 shows a locked state in which the valve 200 is fully inserted in the protective cap 100. At this time, all threads 201 have past the fingers 105. Therefore, because of the reaction force of the flexible portion 106, the fingers 105 abut the valve port 202 and stay curled towards the closed end 102. Since the fingers 105 are curled towards the closed end 102, the fingers 105 prevent easy removal of the cap, thus providing protection from dirt and contamination which also protects the valve threads. Because of the curl, the fingers prevent easy removal of the cap because the fingers are locked under the threads. To remove the cap, the user must pull the tab 110, to break the frangible members 108 that define the tear strip 109. Pulling on the tab 110 removes the tear strip 109 and splits the cap, which separates the fingers from the threads and thus allows the cap to be removed. A valve without a cap or a valve with a damaged cap provides a visual indication of tampering. Further, the cap is destroyed by pulling the tab and removing the tear strip, so the cap cannot be re-used. Customers seeing an undamaged cap on the valve thus know that the tank is full.

It is noted that the cap may have indicia on the top exterior surface to indicate that the tank is full. Safety information and/or warning messages may also be shown on the top exterior surface. Removal instructions or indicia may appear on the pull tab. Those skilled in the art recognize that the indicia and its location on the cap or tab may be changed from the exemplary embodiments.

While the invention has been described in conjunction with the specific embodiments described above, many equivalent alternatives, modifications and variations may become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

What is claimed is:

1. A protective cap for a threaded valve stem, comprising:

a generally cylindrical portion including a closed end, an open end and a cylindrical wall portion therebetween, the cylindrical wall portion having an external surface and an internal surface;

a plurality of locating ribs located on the internal surface; and a plurality of fingers projecting radially inward from the internal surface and remotely from the open end, each finger being located between a pair of the locating ribs, each locating rib being located between a pair of the fingers, thus each finger and locating rib being in an alternating manner and having a free end and a flexible portion adjacent the internal surface for locating the fingers in unlocked state and a locked state, the free end of the fingers in the unlocked state extending toward but not extending beyond the open end and the fingers in the locked state curling toward the closed end.

2. The protective cap of claim 1, further comprising a pair of frangible members located on the external surface and extending between the closed end and the open end to define a tear strip, the pair of frangible members being located between a pair of adjacent locating ribs.

3. The protective cap of claim 2, further comprising a pull tab connected to the tear strip at the open end.

4. The protective cap of claim 1, wherein the locating ribs define a space for the fingers to move from the unlocked state to the locked state.

5. The protective cap of claim 1, wherein the cap is made of thermoplastic resin.

6. A protective cap for a threaded valve stem, comprising:

a generally cylindrical portion including a closed end, an open end and a cylindrical wall portion therebetween, the cylindrical wall portion having an external surface and an internal surface;

a plurality of locating ribs located on the internal surface and extending between the closed end and the open end;

a pair of frangible members located on the external surface and extending between the closed end and the open end to define a tear strip, the pair of frangible members being located between a pair of adjacent locating ribs;

a pull tab connected to the tear strip at the open end; and a plurality of fingers projecting radially inward from the internal surface and remotely from the open end, each finger being located between a pair of the locating ribs, each locating rib being located between a pair of the fingers, thus each finger and locating rib being in an alternating manner.

7. The protective cap of claim 6, wherein each finger has a free end, and the free end of the fingers extending downwardly towards the open end.

8. The protective cap of claim 7, wherein, when installed, the plurality of fingers curl under threads of the threaded valve stem and extend towards the closed end.

9. The protective cap of claim 6, wherein the cylindrical portion has a constant diameter.

10. The protective cap of claim 6, wherein the cap is made of thermoplastic resin.

* * * * *